US005218982A

United States Patent [19]

Kenji

[11] Patent Number: 5,218,982

[45] Date of Patent: Jun. 15, 1993

[54] HANDY HUT

[76] Inventor: Matsumura Kenji, 3-25-205, Tonoyama-cho, Nishinomiya-shi, Hyogo-Ken, 662, Japan

[21] Appl. No.: 923,930

[22] PCT Filed: Jan. 5, 1991

[86] PCT No.: PCT/JP91/00023

§ 371 Date: Sep. 8, 1992

§ 102(e) Date: Sep. 8, 1992

[87] PCT Pub. No.: WO92/12312

PCT Pub. Date: Jul. 23, 1992

[51] Int. Cl.[5] ..... E04H 15/04

[52] U.S. Cl. ..... 135/90; 43/1

[58] Field of Search ..... 135/90, 900, 901, 902; 43/1

[56] References Cited

U.S. PATENT DOCUMENTS

| | | | |
|---|---|---|---|
| 3,116,808 | 3/1962 | Riley | 135/90 X |
| 4,284,095 | 8/1981 | Norton | 135/90 X |
| 4,805,655 | 2/1989 | Justice | 135/90 |
| 4,813,441 | 3/1989 | Kepley | 135/90 |
| 4,922,942 | 5/1990 | Schaeffer | 135/90 |
| 4,951,696 | 8/1990 | Jones, Sr. | 135/90 |
| 5,042,517 | 8/1991 | Stewart | 135/90 |

FOREIGN PATENT DOCUMENTS 33-12960 8/1958 Japan .

*Primary Examiner*—Henry E. Raduazo
*Assistant Examiner*—Creighton Smith
*Attorney, Agent, or Firm*—Wenderoth, Lind & Ponack

[57] ABSTRACT

Disclosed is a safe and portable tent which can be set up on a natural tree in a mountain or in a camp site without the need of cutting down trees or leveling the ground, and which can be assembled and disassembled easily.

This tent comprises a support frame 3, seating plate 4 laid thereon, a collapsible support plate 2 having a support frame 3, a seating plate 4 laid thereon and stanchions 5 erected at the four corners and intermediate points of the frame and connected together by a life line 5' and a tent 1 spread over the support base 2. The support frame 3 is coupled to a mid-level fixing ring 7 by means of a coupling member 6 and its outer end is supported by supporting rods 8 coupled to a lower fixing ring 7. The central stanchion 5 near the base end of the support base 2 is longer than the other stanchions. Ropes for supporting the tent 1 extends between the top of the long stanchions and the tops of the stanchions at the corners and a glass fiber rod 18 is provided to extend between the tops of the long stanchion and the outer central stanchion 5. The tent 1 and a hat canvas 1' are supported thereon. A hanger 28 is provided on the upper fixing ring 7. When the tent is not in use, it is placed and stored on the hanger 28.

4 Claims, 7 Drawing Sheets

HANDY HUT

TECHNICAL FIELD

This invention relates to a hut or tent used by securing it to a tree in a forest.

BACKGROUND ART

When camping in mountains or the like, a tent pitched on the ground is used. In assembling such a conventional tent, supporting rods are put up on the four corners of the camp site, a waterproof tent is spread over the site, riggings such as ropes are connected to stakes driven in the ground and erecting the tent by pulling the supporting rods at their ends.

But, since such a conventional tent is usually erected on the ground, if one has to spend a night in such a tent pitched deep in a mountain, he might be attacked by snakes or bears. Thus, it is sometimes very dangerous to pitch a tent on the ground. Also, in order to use a certain area in a mountain as a camp site for erecting a tent, one has to cut down trees and level the ground so that the place can be used as a camp site. Such work tends to incur much cost and leads to the destruction of nature.

Further, in order to pitch such a tent, one has to use various kinds of and a large number of accessory parts such as supporting rods and ropes. When assembling a tent, such parts have to be placed in predetermined positions in predetermined order. Such work is troublesome and complicated.

This invention was made in view of the problems of the conventional tents and its object is to provide a tent which can be mounted on a tree in a forest by mounting a support frame having a simple structure on the tree and by spreading a tent over the frame, and which requires no cutting of trees nor leveling of the ground.

DISCLOSURE OF THE INVENTION

According to this invention, there is provided a tent comprising a support base having a support frame large enough for a person to lie thereon, a seating plate laid on the frame, and stanchions erected at the four corners and intermediate points of the support frame, a mid-level fixing ring secured to a tree for coupling a base end of the support base to the tree, a lower fixing ring secured to the tree at a point lower than the support base for coupling an outer end of the support base to the tree, supporting rods that extend between the outer end of the support base and the fixing ring corresponding thereto, at least one of the stanchions being longer than the other stanchions, and a tent spread over the top of the long stanchion and the tops of the other stanchions.

This tent can be attached to a tree of a suitable size at any desired place in a forest.

In mounting, the fixing rings are secured to a tree. The support base coupled to the fixing rings is supported on the support member to fix it in position. By spreading the tent over the support plate thus securely fixed to the tree, the tent is assembled. Since the rings are designed so that the bark is not tightened directly, they never inhibit the growth of the tree.

Since this tent is attached to a tree at a middle height thereof, by climbing into the tent like a bird getting into its own nest, one is perfectly safe against external enemies.

The tent according to the embodiment has a stanchion longer than the other stanchions and ropes extending between the top of the long stanchion and the tops of the other stanchions. The tent is supported on the ropes, so that it is prevented from sagging between support points.

Also, the tent according to the embodiment may have an upper fixing ring at a point higher than the mid-level fixing ring. Guys are provided between this ring and the support base and between the mid-level fixing ring and the support base to prevent the support base from rotating.

Other features are described with reference to the embodiment.

BEST MODE FOR EMBODYING THE INVENTION

We shall now describe an embodiment of this invention with reference to the accompanying drawings.

Figure 1:
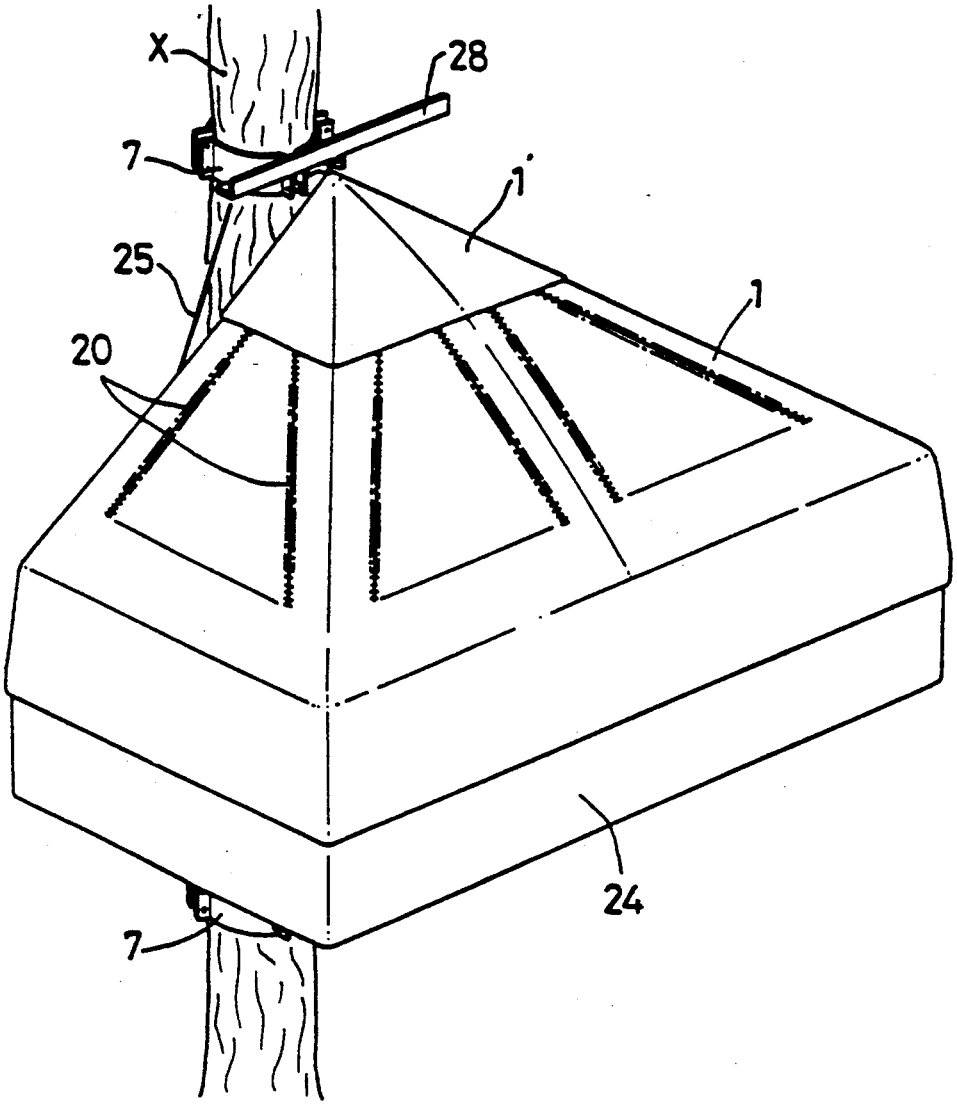
FIG. 1 is an external view of an embodiment of the tent.

FIG. 1 shows the external appearance of the tent according to this invention. Numeral 1 designates a tent or hut, 1' a hat canvas, 7 a fixing ring, 28 a hanger, 24 a skirt canvas and X a tree.

Figure 2:
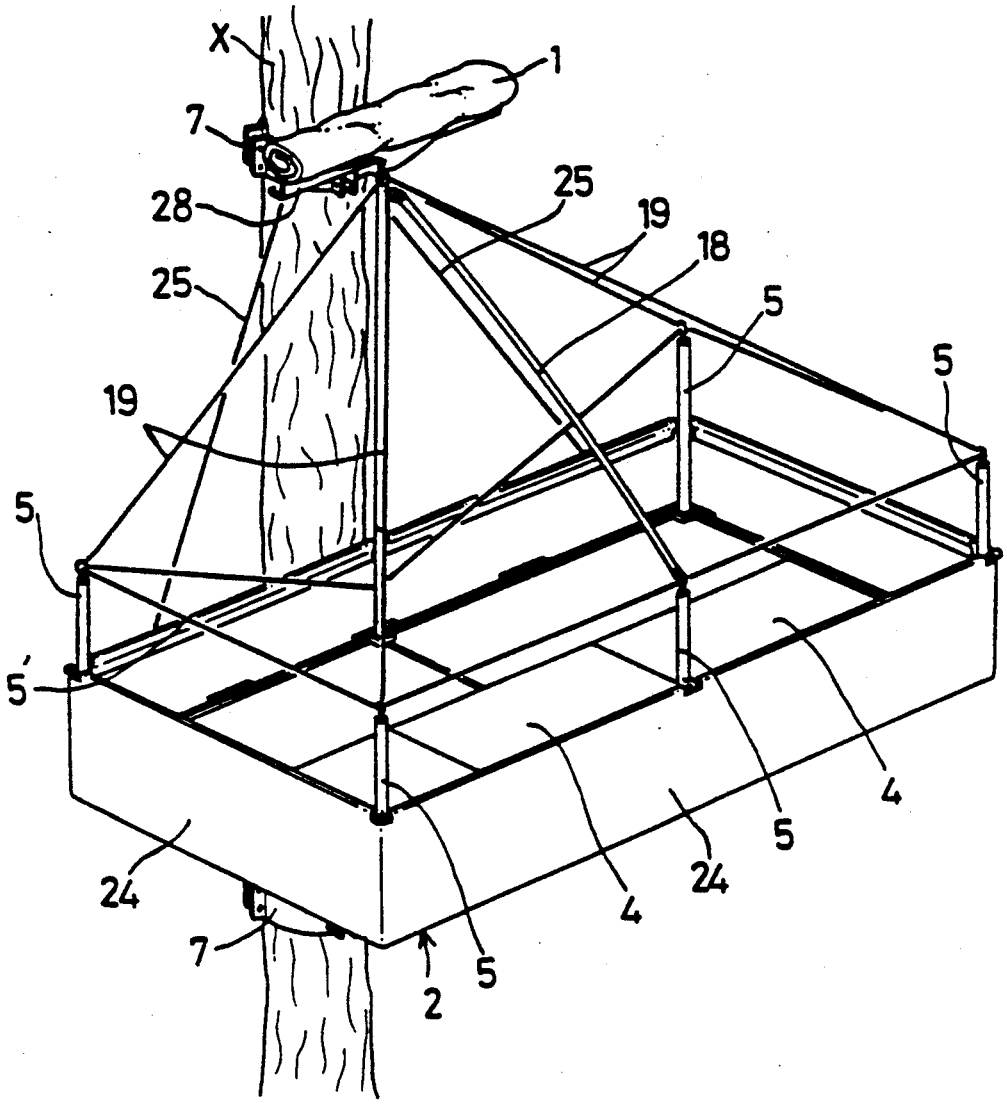
FIG. 2 is a perspective view of the assembled support base.
Figure 3:
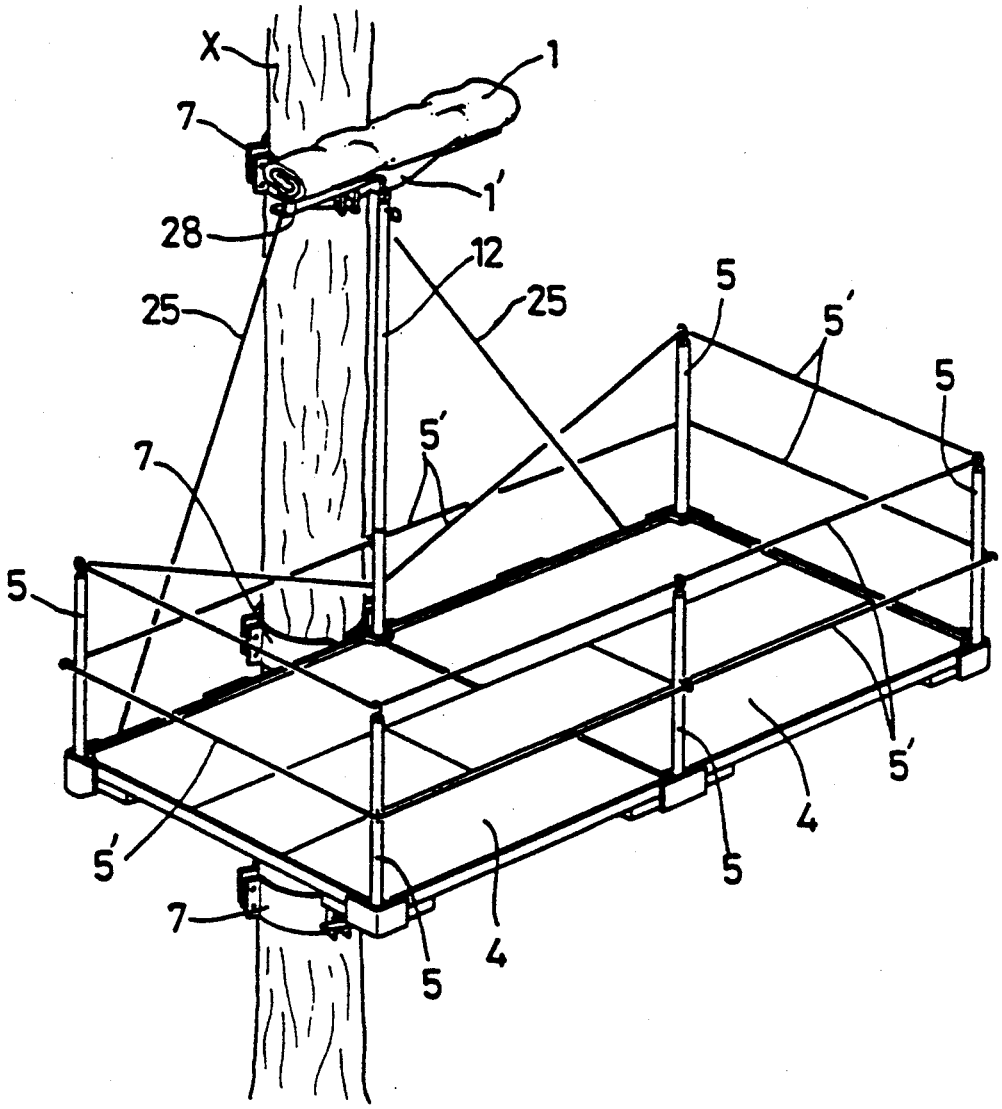
FIG. 3 is a perspective view of the support base with the skirt canvas removed.
Figure 4:
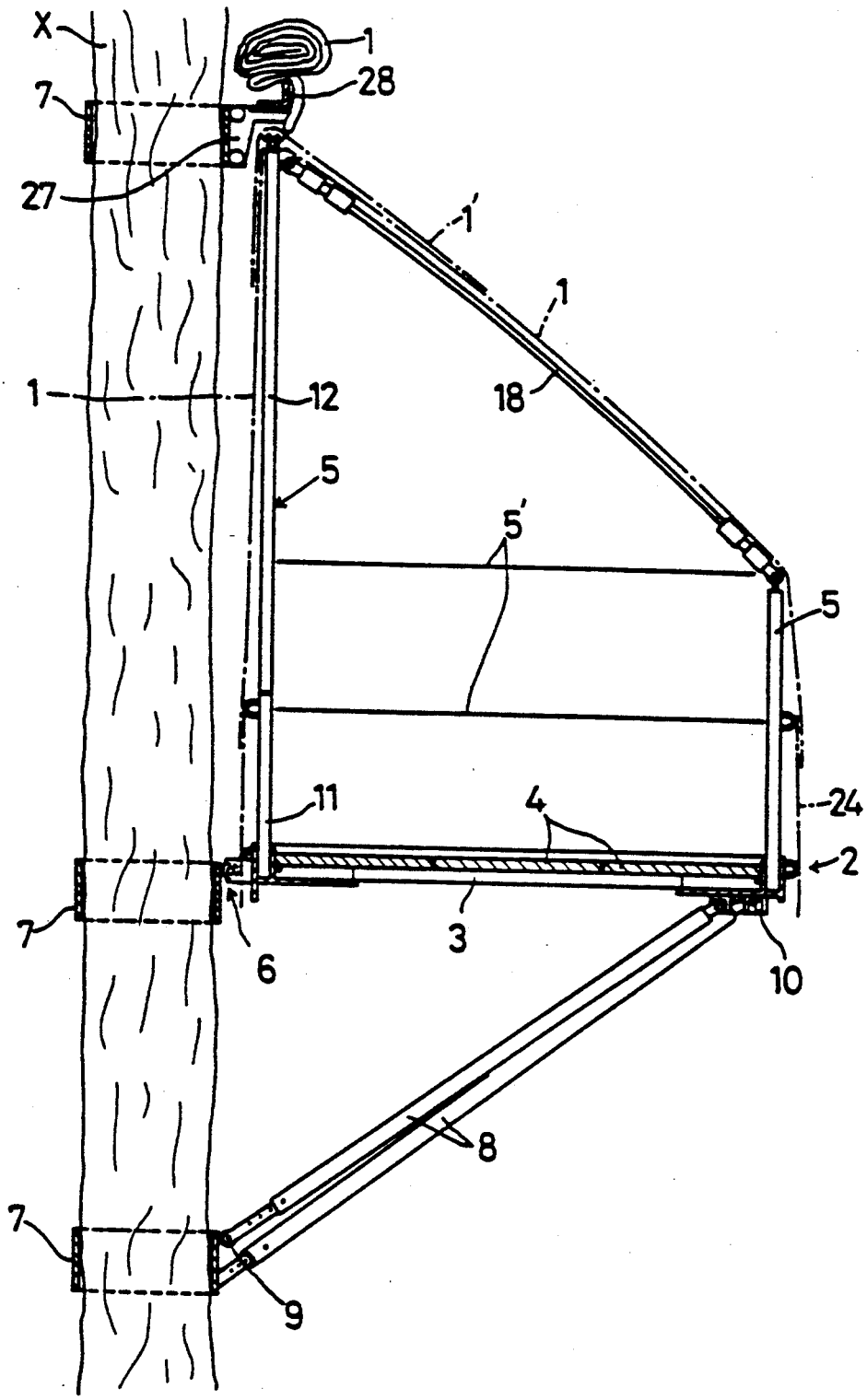
FIG. 4 is a sectional view of an essential portion of the tent.
Figure 6:
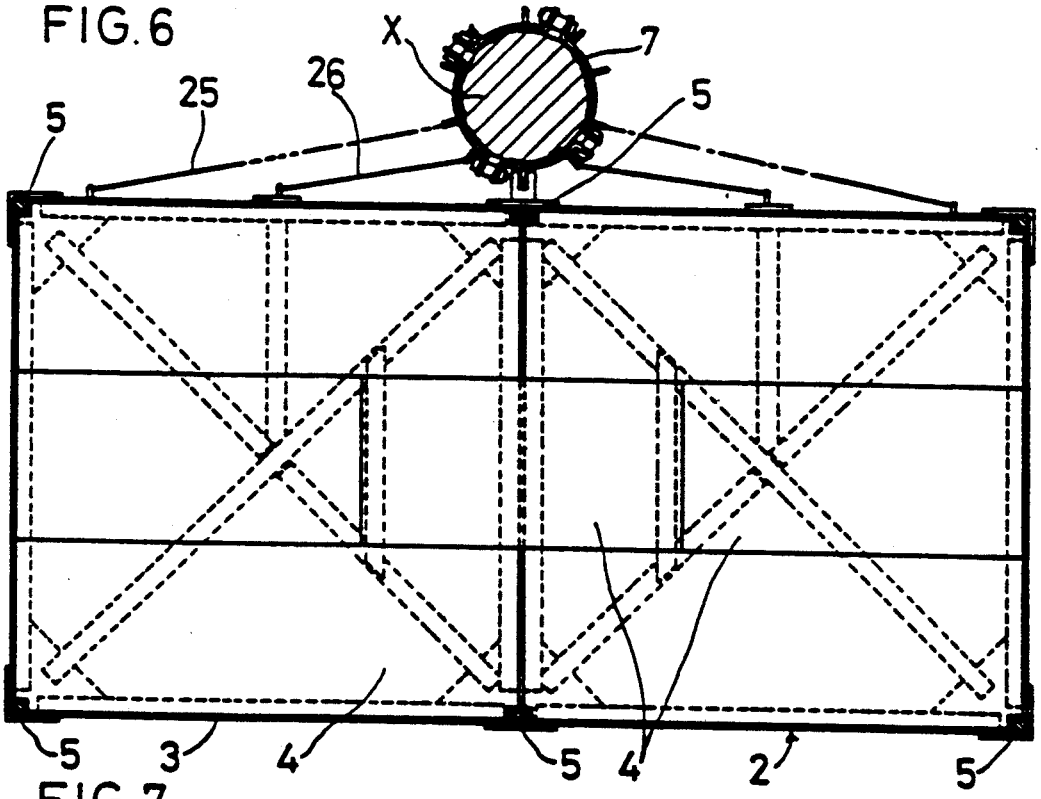
FIG. 6 is a plan view of the support base.
Figure 7:
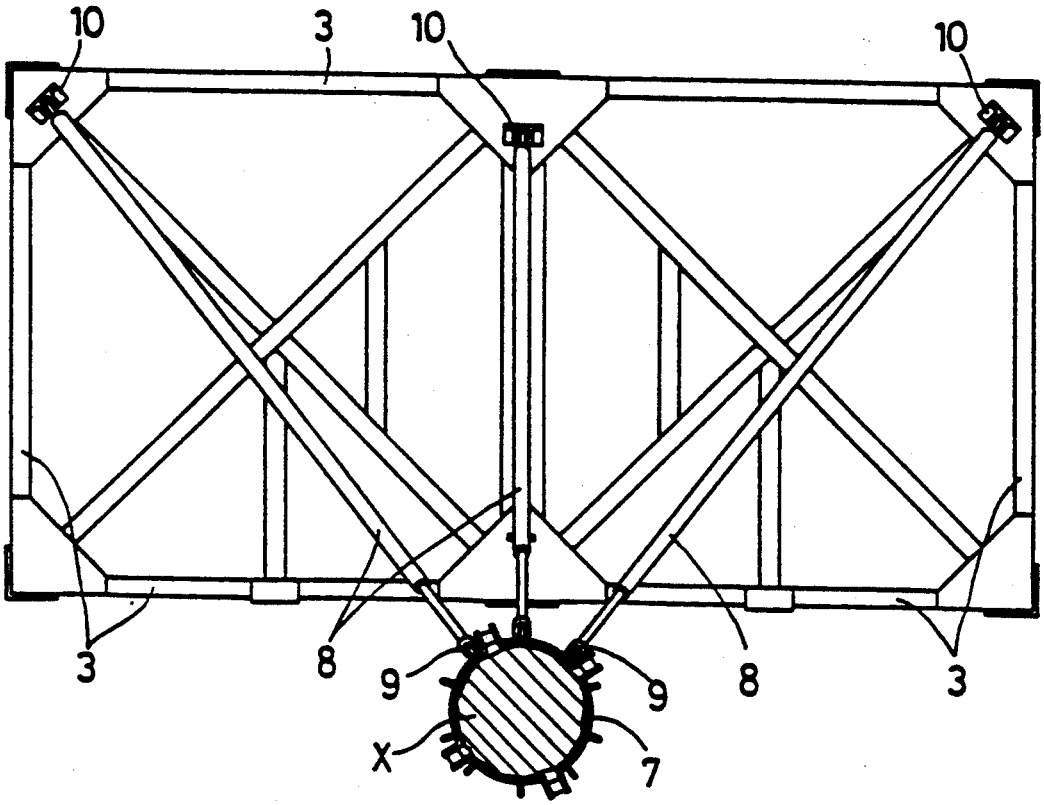
FIG. 7 is a bottom view of the fixing ring.

As shown in FIGS. 2–4, the tent of this embodiment has a support base 2 under the tent 1. The support base 2 has a support frame 3 large enough for a person to be able to lie flat thereon. As shown in FIGS. 6 and 7, the support frame 3 comprises longitudinal, lateral and diagonal frames. On the support frame 3, a plurality of seating plates 4 are placed. Stanchions 5 are erected at the four corners and intermediate points of the support frame 3. They are connected together at their tops and mid-points by life lines 5'.

The support base 2 is coupled to the mid-level fixing ring 7 through a coupling member 6 provided at the base end of the support base 2. A plurality of supporting rods 8 are provided to extend obliquely between the lower fixing ring 7 and the outer end of the support base through couplings 9 and 10. The support base 2 is thus fixed to the tree.

Of the stanchions 5 provided on the support base 2, the center stanchion 5 near the base end of the support base (see FIG. 3) is about twice as long as the other stanchions 5. This stanchion is shown in greater detail in FIG. 5.

As shown in the figure, the center stanchion 5 comprises a short stanchion 11 which is of substantially the same height as the mid-points of the other stanchions and a long stanchion 12 connected to the short one. Its entire length is adjustable. The length-adjusting mechanism comprises nuts 13 and 14 provided at the top of the stanchion 11 and the bottom end of the stanchion 12 and a bolt 15 threaded into both nuts.

Near the top end of the stanchion 12, there are provided an eye bolt 16 and a swivel-carrying shackle 17 thereover. To the eye bolt 16 is connected, as shown in FIG. 4, a single glass fiber rod 18, which is coupled at the other end to the top of the stanchion 5 at the outer end. The glass fiber rod 18 has a length such that when mounted, it curves slightly upward, so as to provide as spacious a tent interior as possible.

To the above-described center stanchion 5 are connected, besides the glass fiber rod 18, ropes 19 for pitching the tent that extend from the corner stanchions 5 (see FIG. 2).

Figure 5:
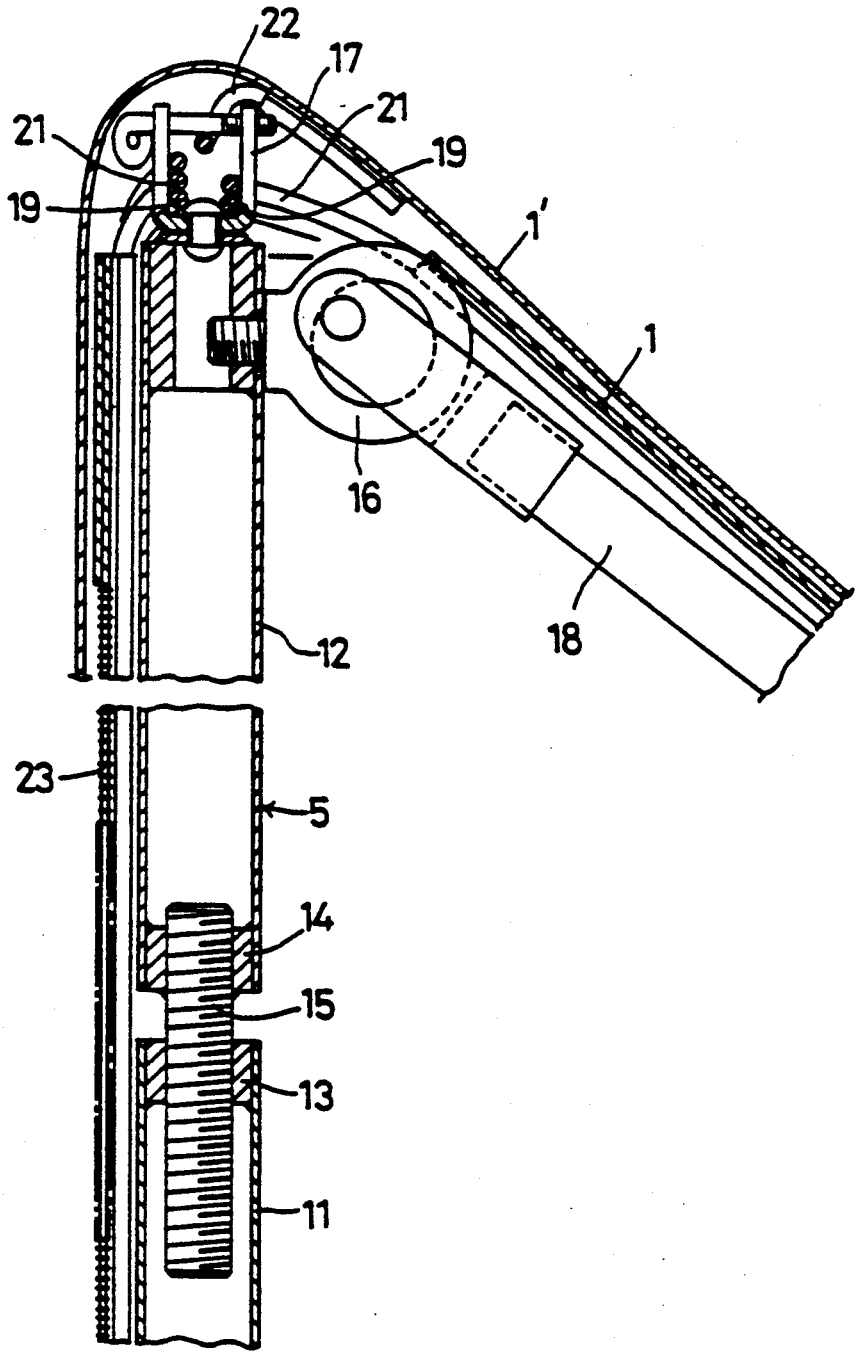
FIG. 5 is a detailed view of the center stanchion near the top.

The tent 1 is spread over the ropes 19 and the glass fiber rod 18 as shown in FIGS. 4 and 5.

The tent 1 is in the shape of a quadrangular pyramid and has on each side zippers 20 defining a window. Inside each window is provided an unillustrated screen. The hat canvas 1' is put on top of the tent 1.

FIG. 5 shows the detailed structure near the top of the center stanchion 5 with the hat canvas 1' put on the tent 1. As shown, the tent 1 is spread by connecting the ends of ropes 21 inserted through corners formed in the respective sides of the tent 1 to the shackle 17. The hat canvas 1' to be put thereon is secured in position by connecting the ends of a rope 22 to the shackle 17. 23 is a zipper provided in the center of the backside of the tent 1, defining an entrance/exit.

The skirt canvas 24 extends the entire circumference of the tent outside the stanchions 5. 25 and 26 are guys for preventing the support base 2 from rotating. The guy 25 is provided between the support base 2 and the upper fixing ring 7 and the guy 26 is between the support base 2 and the mid-level fixing ring 7.

As shown in FIG. 4, the upper fixing ring 7 is secured to the tree X at a point slightly above the top of the tent 1. To the fixing ring 7 is mounted a hanger 28 through a coupling portion 27. When not in use, the tent 1 is folded and stored on the hanger 28.

Figure 8:
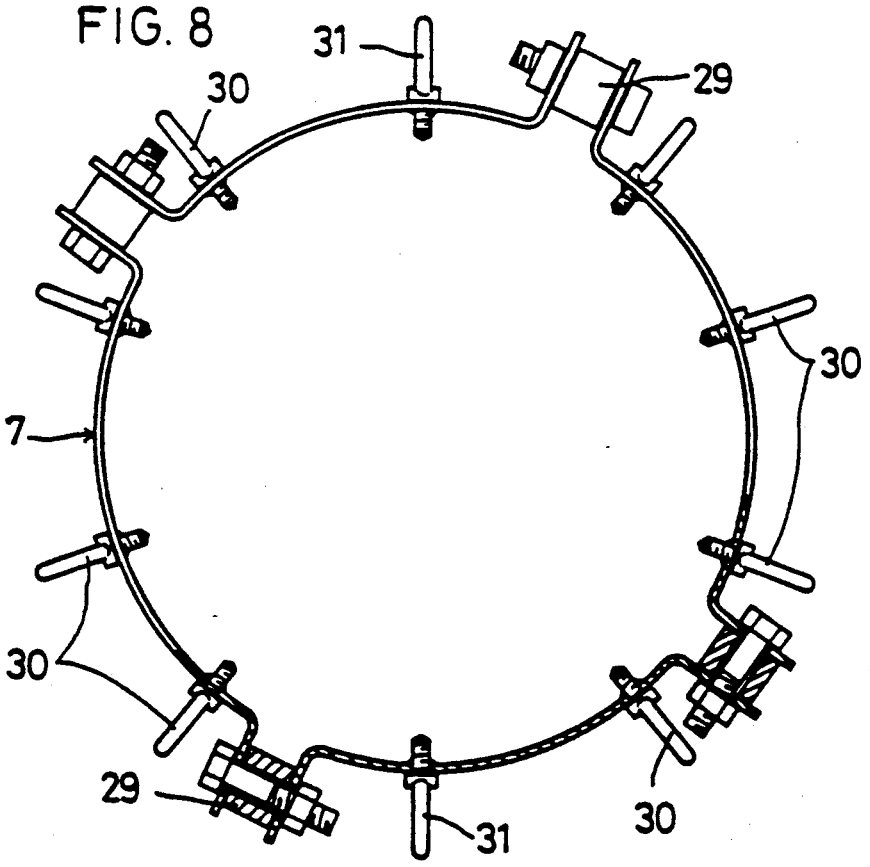
FIG. 8 is a detailed view of the fixing ring.
Figure 9:
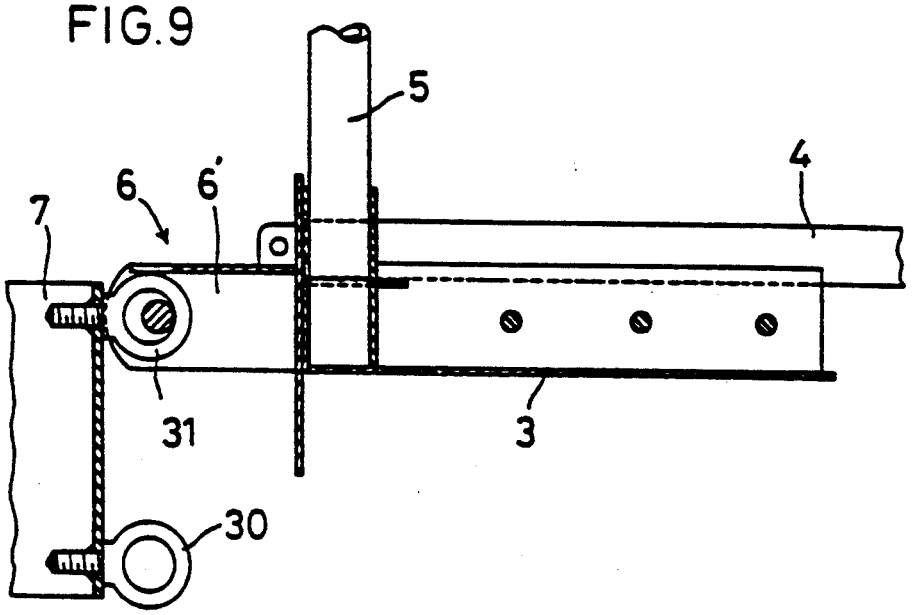
FIG. 9 is a detailed view of the coupling portion of the support base.

FIG. 8 shows the details of the fixing rings 7 and FIG. 9 shows the details of the coupling member 6. Each fixing ring 7 comprises four equally divided ring parts and its diameter is adjustable according to the diameter of the tree X by adjusting its collars 29. A plurality of eye bolts 30 and 31 are provided at predetermined pitches.

When mounting, the eye bolts 30 are tightened until the fixing ring 7 is securely fixed to the tree X. A bracket 6' as the coupling member 6 provided at the base end of the support base 2 is coupled to one of the eye bolts 31. Another eye bolt 31 is provided at diametrically opposite position, so that two sets of tents can be coupled to a single fixing ring 7.

The above-described tent of this embodiment is set up on a tree X of a suitable thickness in a mountain. The tent is set up at a height at which one can climb in. In a dangerous area, it is mounted at as high a place as possible.

In mounting, the upper, middle and lower fixing rings 7 are securely fixed to the tree X. The support base 2 is coupled to the middle fixing ring 7, the supporting rods 8 to the lower fixing ring 7 and the rod 18, ropes 19 and guys 25 to the upper fixing ring. The framework of the tent is thus assembled. The tent is completed by spreading the tent over the thus assembled support base 2. When not in use, as shown in FIGS. 2 and 3, the tent 1 is rolled up and put on the hanger 28. In use, the tent 1 is unloaded from the hanger 28 and spread over the support base 2.

Steps or handles may be secured to the tree X beforehand so that one can climb into the tent 1 easily. Using the steps and the like, one climbs the tree and enters into the tent. If it is hot, the zippers 20 may be lowered to open the windows.

When using the above-described tent in a camp site or the like, it may be kept attached to a tree throughout the camping season. At the end of the season, it can be disassembled and stored in a storage place.

In the above embodiment, the support base 2 is supported by the supporting rods 8. But it may be suspended from the upper fixing ring. Also, in the embodiment, the tent is quadrangular prism-shaped. But it may be dome-shaped or of any other shape.

INDUSTRIAL APPLICATION

In use, the tent according to the present invention, as described above in detail, is suspended from a tree in a camp site in a forest or the like. As the case may be, two such tents may be secured to a single tree.

The cover of this tent may be made of a cloth or a canvas made of synthetic fiber. The support base and the fixing rings are typically made of a metal. Such tents may be set up in a great number in a camp site or the like.

I claim:

1. A tent comprising a support base having a support frame having four corners and intermediate points large enough for a person to lie thereon, a seating plate laid on said frame, and stanchions erected at the four corners and intermediate points of said support frame, a mid-level fixing ring securable to a tree for coupling a base end of said support base to the tree, a lower fixing ring securable to the tree at a point lower than said support base for coupling an outer end of said support base to the tree, supporting rods that extend between the outer end of said support base and the fixing ring corresponding thereto, at least one of said stanchions being longer than the other stanchions, and a tent spreadable over the top of said long stanchion and the tops of said other stanchions.

2. A tent as claimed in claim 1, further comprising ropes connecting the top of said long stanchion to the tops of said other stanchions for supporting said tent.

3. A tent as claimed in claim 1, further comprising an upper fixing ring securable to the tree at a point higher than said mid-level fixing ring, and guys provided between said upper fixing ring and said support base and between said mid-level fixing ring and said support base, whereby said support base is prevented from rotating.

4. A tent as claimed in claim 1, further comprising a hanger provided on the end of said upper fixing ring, whereby said tent can be wound around said hanger when not in use.

* * * * *

UNITED STATES PATENT AND TRADEMARK OFFICE

CERTIFICATE OF CORRECTION

PATENT NO. : 5,218,982

DATED : June 15, 1993

INVENTOR(S) : Matsumura Kenji

It is certified that error appears in the above-identified patent and that said Letters Patent is hereby corrected as shown below:

On title page, item [19] "Kenji" should read --Matsumura-- item [76] "Matsumura Kenji" should read --Kenji Matsumura--

Signed and Sealed this

First Day of February, 1994

*Attest:*

*Attesting Officer*

BRUCE LEHMAN

*Commissioner of Patents and Trademarks*